United States Patent [19]

Doane

[11] Patent Number: 4,498,368

[45] Date of Patent: Feb. 12, 1985

[54] FRANGIBLE FLY THROUGH DIAPHRAGM FOR MISSILE LAUNCH CANISTER

[75] Inventor: William J. Doane, San Diego, Calif.

[73] Assignee: The United States of America as representedby the Secretary of the Navy, Washington, D.C.

[21] Appl. No.: 539,503

[22] Filed: Oct. 6, 1983

[51] Int. Cl.[3] ..... F41F 3/04

[52] U.S. Cl. ..... 89/1.817; 220/89 A

[58] Field of Search ..... 89/1.817, 31, 1.81, 89/1.816; 42/1 N; 220/89 A, 89 R

[56] References Cited

U.S. PATENT DOCUMENTS

| | | | |
|---|---|---|---|
| 2,875,921 | 3/1959 | Coffman | 220/89 A |
| 2,953,279 | 9/1960 | Coffman | 220/89 A |
| 3,005,573 | 10/1961 | Dawson et al. | 220/89 A |
| 3,031,932 | 5/1962 | Fite, Jr. | 89/1.817 |
| 3,106,863 | 10/1963 | Robert et al. | 89/1.817 |
| 3,140,638 | 7/1964 | De Luca | 89/1.817 |
| 3,194,119 | 7/1965 | Robert et al. | 89/1.814 |
| 3,204,585 | 9/1965 | Carlisle | 52/1 |
| 3,257,026 | 6/1966 | Taylor | 220/89 A |
| 3,279,319 | 10/1966 | Semonian et al. | 89/1.81 |
| 3,362,291 | 1/1968 | De Luca | 89/1.817 |
| 3,742,814 | 7/1973 | Kroh | 89/1.817 |
| 3,789,729 | 2/1974 | Aupy | 89/1.817 |
| 3,962,951 | 6/1976 | Schenk | 89/1.817 |
| 3,970,006 | 7/1976 | Copeland et al. | 89/1.817 |
| 4,301,708 | 11/1981 | Mussey | 89/1.817 |

FOREIGN PATENT DOCUMENTS

| | | | |
|---|---|---|---|
| 1157966 | 11/1963 | Fed. Rep. of Germany | 42/1 N |
| 1436333 | 3/1966 | France | 89/1.817 |

*Primary Examiner*—David H. Brown
*Assistant Examiner*—John E. Griffiths, Jr.
*Attorney, Agent, or Firm*—Robert F. Beers; Joseph M. St. Amand

[57] ABSTRACT

A frangible fly through diaphragm for missile launcher tubes consists of two epoxy and fiberglass plies with each ply being scored in predetermined patterns. The plies are bonded together and a Mylar/aluminum ply can be located on the missile side to provide gas sealing and electromagnetic interference protection. A segmented foam rubber outer layer can also be provided for additional protection from missile jet plumes.

22 Claims, 6 Drawing Figures

FRANGIBLE FLY THROUGH DIAPHRAGM FOR MISSILE LAUNCH CANISTER

BACKGROUND OF THE INVENTION

This invention relates to a closure for a missile launching tube and more particularly to a frangible fly through missile tube closure.

In the past, launch tube closures through which missiles exit from missile launchers have used rigid doors or closures that are ruptured by explosive means prior to missile launch, or a break-apart foam plastic diaphragm ruptured by the missile as it exits has been used. The disadvantage of these type closures are their complexity, difficulty in manufacturing, costliness, or weaknesses to differential pressures encountered. Various attempts have been made to dispense with explosive or hatch mechanisms and substitute therefor simple frangible covers which overlie the missile tube opening. However, such attempts have not met with great success due to the lack of proper environmental insulation, lack of resistance to external blasts and also because their cumbersome design requires extensive handling during missile reloading.

OBJECTS OF THE INVENTION

An object of the invention is to provide a launch tube closure that can be easily ruptured by the missile upon launching.

Another object of the invention is to provide a launch tube closure that will not impede the exiting of the missile from a launch tube.

A further object of the invention is the provision of a new and improved frangible missile launcher cover assembly through which a missile can be readily launched directly.

SUMMARY OF THE INVENTION

Accordingly, the foregoing and other objects are attained by providing a closure for a missile launch tube which resists a large uniformly distributed internal pressure load but which will fail under the lower concentrated central loading by the nose cone of a missile being launched.

The frangible diaphragm consists of a plurality of plies and provides environmental protection for encannistered missiles. The diaphragm is designed to fail when impacted by the missile nose cone during launch with a minimum resistance force imposed on the missile.

Simplicity of manufacture is provided by an arrangement of scored plies. There is no loose debris after launch. Tearing is controlled by the arrangement of alternating plies to align score pattern of one ply with the adjacent plies tear direction. The geometric tear pattern provides for minimum drag force on a missile as it is launched.

DESCRIPTION OF THE PREFERRED EMBODIMENTS

The basic material for the diaphragm in the preferred embodiment of this invention is a woven cloth of fiberglass strands impregnated with an epoxy.

The fiberglass cloth material tears easily in two directions, each direction being 90° to the other (i.e., along the warp and woof of the fiberglass cloth). The fiberglass cloth resists tearing in all other directions. The epoxy allows bonding of a plurality of fiberglass cloth plies to form an integral unit.

Figure 1:
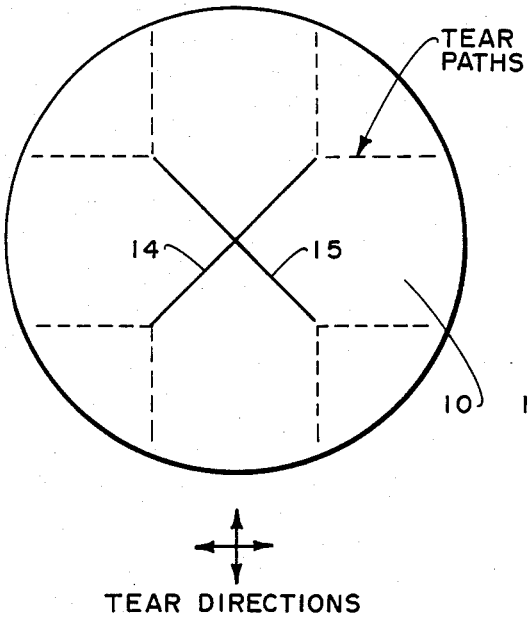
FIG. 1 shows a diagram of the score and tear patterns for one ply of the diaphragm of the present invention.
Figure 2:
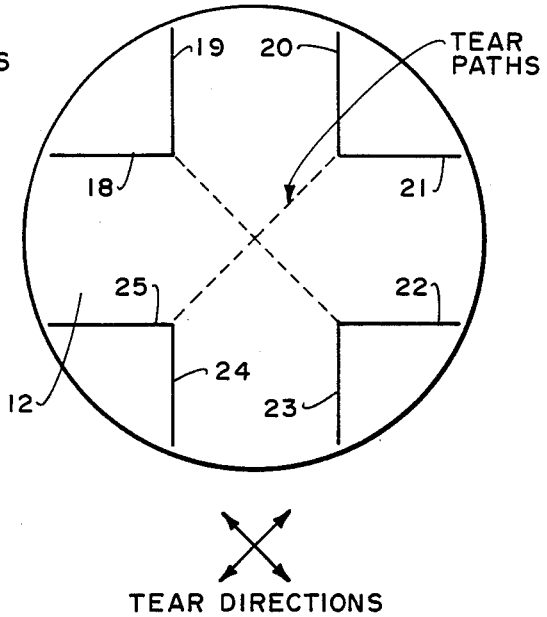
FIG. 2 shows a diagram of the score and tear patterns for a second ply of the diaphragm of the present invention.

The basic unit of each frangible fly through diaphragm is two plies of fiberglass cloth 10 and 12, each scored (cut through) in the patterns shown in FIGS. 1 and 2, respectively. Fiberglass cloth ply 10 is scored along lines 14 and 15, as shown in FIG. 1, and fiberglass ply 12 is scored along lines 18 & 19, 20 & 21, 22 & 23, and 24 & 25, as shown in FIG. 2. The tear directions of the fiberglass cloth fabric for each of plies 10 and 12 are shown in FIGS. 1 and 2, respectively. The tear paths for ply 10 are shown in dashed lines at the ends of score lines 14 and 15 (see FIG. 1), and the tear paths for ply 12 are shown in dashed lines at the junctures of the score lines 18 & 19, 20 & 21, 22 & 23, and 24 & 25 (see FIG. 2). As shown, the tear paths for each of plies 10 and 12, respectively, are at 45° to their scored lines and to their respective plies, such that the score lines of one ply coincide with the tear paths of an adjacent ply when assembled and bonded together.

The fiberglass cloth plies 10 and 12 are bonded together with an epoxy such that the tear paths for ply 10 are at 45° to the tear path directions of ply 12 (i.e., the warp and woof of the fiberglass cloth fabric of ply 10 is positioned at 45° to the warp and woof of fiberglass cloth fabric of ply 12.

Figure 3:
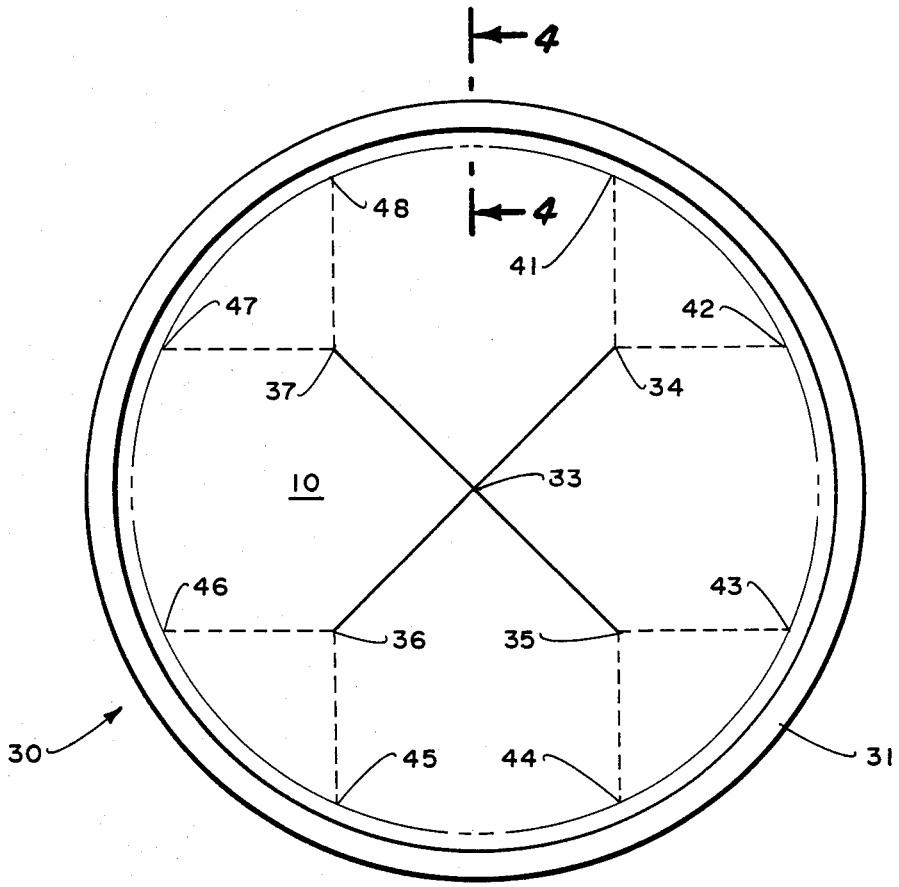
FIG. 3 shows the plan view of a diaphragm for a preferred embodiment of the invention.
Figure 4:
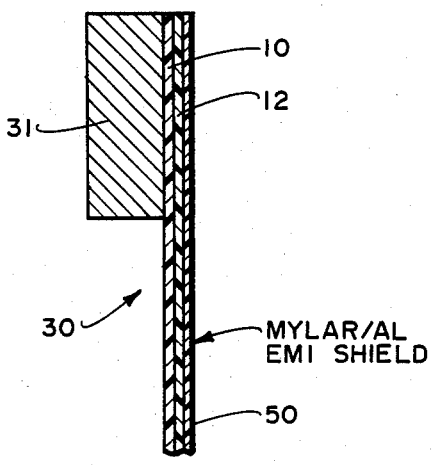
FIG. 4 is a partial cross-sectional view along line 4—4 of FIG. 3.

Missile launching tube diaphragm assembly 30, formed from plies 10 and 12, assembled with ply 10 on top, as shown in FIGS. 3 and 4, includes a mounting ring or frame 31 to which the plies are bonded for easy installation, removal and replacement of the assembly to a missile launching tube.

During a missile launch, the diaphragm will begin to fail at point 33, in the center of the diaphragm, when impacted by a missile nose cone. Ply 12 will begin tearing from point 33 to point 34, point 33 to point 35, point 33 to point 36, and point 33 to point 37, because the score pattern in ply 10 is aligned with the tear direction of the fiberglass cloth in ply 12. When the tear reaches points 34, 35, 36 and 37 where the scores in ply 12 begin, the tearing will take place in ply 10 along its tear direction from point 34 to points 41 & 42, from point 35 to points 43 & 44, from point 36 to points 45 & 46 and from point 37 to points 47 & 48, and a little beyond the edge of the missile diameter to allow for passage of the missile.

A thin Mylar/aluminum ply 50 (e.g., 0.003 inch thick) can be provided on the missile side of the diaphragm 30, as shown in FIG. 4, for gas sealing and electromagnetic interference protection. The Mylar/aluminum shield can be scored lightly with the same pattern as plies 10 and 12 with the Mylar surface facing ply 12.

Figure 5B:
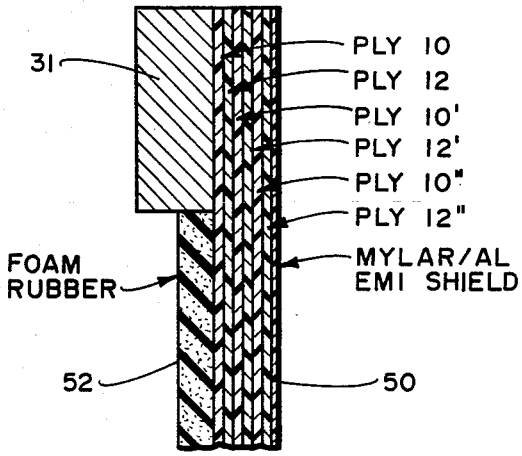
FIGS. 5*a* and 5*b* show plan and partial cross-sectional views, respectively, of another embodiment using additional plies.
Figure 5A:
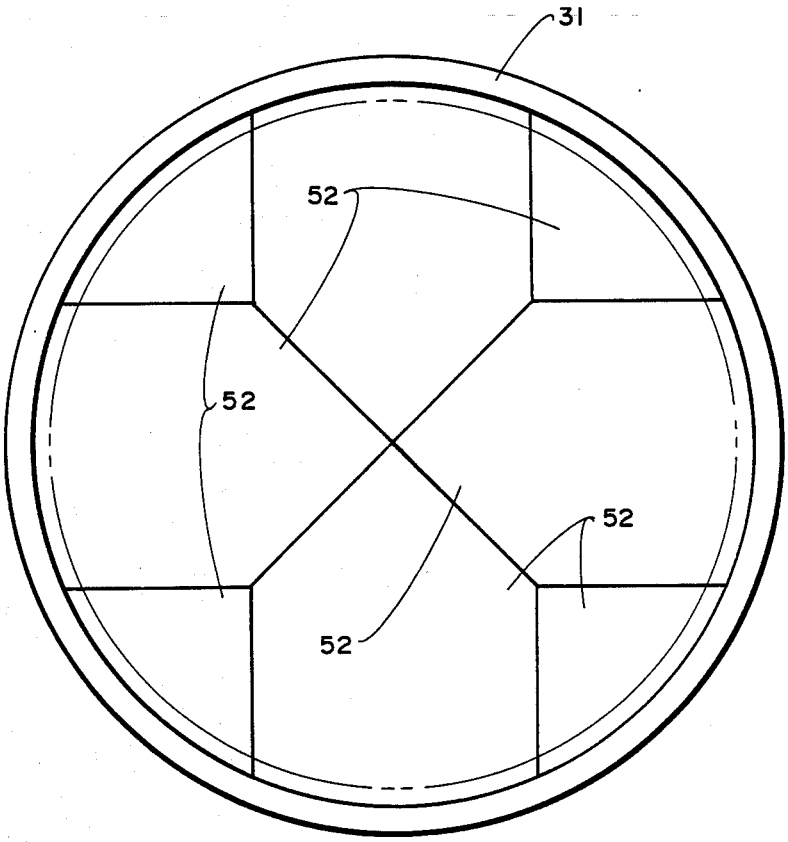

Foam rubber segments 52 (e.g., 0.10 inch thick) shaped and aligned to the score/tear patterns of plies 10 and 12, as shown in FIG. 5*a*, can be laminated on the outer surface of the diaphragm assembly (see FIG. 5*b*) to provide further protection and insulation from the booster plumes of missiles launched from adjacent missile tube canisters. The foam rubber segments 52 can also be painted with a protective paint on their outer surface.

Several layers of epoxy impregnated fiberglass plies, such as shown in FIG. 5*b*, can be used with or without the Mylar/aluminum ply 50 or rubber layer 52. In such case plies 10, 10' and 10'' are identical in scoring and positioning with respect to each other and their scoring are at 45° to that of plies 12, 12' and 12'' which are also positioned and scored identically to each other, such that the warp and woof of the fabric of plies 10, 10' and 10'' are at 45° to that of plies 12, 12' and 12''.

Alternatively, rubber coated nylon fabric plies can be used in place of epoxy and fiberglass plies 10 and 12, etc., in the diaphragm assembly 30 shown in either embodiment (FIG. 4 or FIG. 5*b*); however, epoxy impregnated fiberglass plies as previously described are preferred.

Obviously many modifications and variation of the present invention are possible in light of the above teachings. It is therefore to be understood that within the scope of the appended claims the invention may be practiced otherwise than as specifically described.

I claim:

1. A frangible fly through diaphragm assembly for missile launcher tube closures, comprising:

a. a first fabric layer forming a first ply;

b. a second fabric layer forming a second ply;

c. said first and second plies each being operable to tear easily along paths in two directions and to resist tearing in all other directions;

d. said first ply having score lines in a first geometric pattern;

e. said second ply having score lines in a second geometric pattern;

f. said first ply and said second ply being impregnated with an adhesive and bonded together to form a diaphragm unit with the score lines of said first ply being aligned with the direction of the tear paths of said second ply, and score lines of said second ply being aligned with the directions of the tear paths of said first ply;

g. said diaphragm unit being operable to resist a large uniformly distributed pressure load and fail under a lower concentrated central loading by a missile nose cone; the tearing of said diaphragm unit being controlled by the arrangement of said first and second plies wherein the score pattern of one ply aligned with the tear direction of the adjacent ply forms a geometric tear pattern for said diaphragm unit which allows for minimum drag force on a missile as it is launched.

2. A frangible fly through diaphragm assembly as in claim 1 wherein each said first and second plies having a warp and a woof and the two tear path directions of each said first and second plies, respectively, are at 90° to each other and along the warp and woof of each said first and second fabric layers.

3. A frangible fly through diaphragm assembly as in claim 1 wherein the score lines of said first ply are at 45° to the tear paths directions of said first ply, the score lines of said second ply are at 45° to the tear paths directions of said second ply, and the tear path directions of adjacent first and second plies are at 45° to each other.

4. A frangible fly through diaphragm assembly as in claim 1 wherein said first and second fabric layers are of fiberglass cloth and said adhesive is an epoxy.

5. A frangible fly through diaphragm assembly as in claim 1 wherein said first and second fabric layers are of nylon cloth and said adhesive is rubber.

6. A frangible fly through diaphragm assembly as in claim 1 wherein the plies of said diaphragm unit are bonded to a mounting frame for easy installation, removal and replacement of the assembly to a missile launcher tube.

7. A frangible fly through diaphragm assembly as in claim 1 wherein a plurality of said diaphragm units are used with said first plies adjacent said second plies and the score patterns of said first plies are aligned with the tear path directions of said adjacent second plies.

8. A frangible fly through diaphragm assembly as in claim 1 wherein a gas sealing layer means is provided.

9. A frangible fly through diaphragm assembly as in claim 1 wherein an electromagnetic interference layer means is provided.

10. A frangible fly through diaphragm assembly as in claim 1 wherein a thin layer of Mylar/aluminum is provided on the missile side of said diaphragm assembly for gas sealing and electromagnetic interference protection.

11. A frangible fly through diaphragm assembly as in claim 1 wherein said Mylar/aluminum layer is scored lightly in alignment with the geometric score patterns of said first and second plies.

12. A frangible fly through diaphragm assembly as in claim 1 wherein thin foam rubber segments shaped and aligned to the geometric tear patterns of said first and second plies are laminated on an outer surface of said diaphragm unit to provide additional protection and insulation against booster plumes from adjacently launched missiles.

13. A frangible fly through diaphragm assembly as in claim 7 wherein the score lines of said first ply are at 45° to the tear paths directions of said first ply, the score lines of said second ply are at 45° to the tear paths directions of said second ply, and the tear path directions of adjacent first and second plies are at 45° to each other.

14. A frangible fly through diaphragm assembly as in claim 7 wherein each said first and second plies having a warp and a woof and the two tear path directions of each said first and seond plies, respectively are at 90° to each other and along the warp and woof of each said first and second fabric layers.

15. A frangible fly through diaphragm assembly as in claim 7 wherein said first and second fabric layers are of fiberglass cloth and said adhesive is an epoxy.

16. A frangible fly through diaphragm assembly as in claim 7 wherein said first and second fabric layers are of nylon cloth and said adhesive is rubber.

17. A frangible fly through diaphragm assembly as in claim 7 wherein the plies of said diaphragm unit are bonded to a mounting frame for easy installation, removal and replacement of the assembly to a missile launcher tube.

18. A frangible fly through diaphragm assembly as in claim 7 wherein a gas sealing layer means is provided.

19. A frangible fly through diaphragm assembly as in claim 7 wherein an electromagnetic interference layer means is provided.

20. A frangible fly through diaphragm assembly as in claim 7 wherein a thin layer of Mylar/aluminum is provided on the missile side of said diaphragm assembly for gas sealing and electromagnetic interference protection.

21. A frangible fly through diaphragm assembly as in claim 7 wherein said Mylar/aluminum layer is scored lightly in alignment with the geometric score patterns of said first and second plies.

22. A frangible fly through diaphragm assembly as in claim 7 wherein thin foam rubber segments shaped and aligned to the geometric tear patterns of said first and second plies are laminated on an outer surface of said diaphragm unit to provide additional protection and insulation against booster plumes from adjacently launched missiles.

* * * * *